United States Patent [19]

Miyata

[11] 4,185,606

[45] Jan. 29, 1980

[54] DECOMPRESSION OPERATIVELY CONNECTED TYPE KICK-STARTING DEVICE

[75] Inventor: Takahide Miyata, Kawagoe, Japan

[73] Assignee: Honda Giken Kogyo Kabushiki Kaisha, Tokyo, Japan

[21] Appl. No.: 858,564

[22] Filed: Dec. 8, 1977

[30] Foreign Application Priority Data

Dec. 13, 1976 [JP] Japan ..... 51/166948[U]

[51] Int. Cl.[2] ..... F01L 13/08

[52] U.S. Cl. ..... 123/182

[58] Field of Search ..... 123/182, 198 F

[56] References Cited

U.S. PATENT DOCUMENTS

| | | | |
|---|---|---|---|
| 2,092,175 | 9/1937 | Loeffler | 123/182 |
| 2,167,854 | 8/1939 | Sheppard | 123/182 |
| 3,361,124 | 1/1968 | Fend | 123/182 |
| 3,362,390 | 1/1968 | Esty | 123/182 |
| 3,620,203 | 11/1971 | Harness | 123/182 |
| 3,897,768 | 8/1975 | Thiel | 123/182 |
| 3,901,199 | 8/1975 | Smith | 123/182 |
| 3,981,289 | 9/1976 | Harkness | 123/182 |

*Primary Examiner*—Ira S. Lazarus

*Attorney, Agent, or Firm*—Irving M. Weiner; Pamela S. Burt; Melvin Yedlin

[57] ABSTRACT

A kick-starter device having a cam connected to a kick-starter spindle. The cam has two cam parts, one of which is a large diameter part for a decompression operation, and the other of which is a small diameter part for resetting operation. The cam is rotated by the driving force of the kick-starter spindle. A cam follower is guided by the large diameter part of the cam rotated by a kicking operation at the time of starting and operates a decompression mechanism, whereby the decompression operation is made in response to engagement of the cam follower with the large diameter part of the cam only within the range of a fixed angle of rotation of the kick-starter spindle.

9 Claims, 9 Drawing Figures

DECOMPRESSION OPERATIVELY CONNECTED TYPE KICK-STARTING DEVICE

The present invention relates to a decompression operatively connected type kick-starter device to be used to start an engine equipped with a decompression device, such as a motorcycle engine.

More particularly, the invention relates to an improved decompression operatively connected type engine kick-starter device wherein a cam is slidably fitted to a starting operating shaft, such as a kick-starter spindle, and is provided with a large diameter part for decompression and a small diameter part for resetting, joining with each other in a single part. A cam follower operating a decompression mechanism is engaged with the large diameter part of the cam in the going stroke of the starting operation to effect an operation of decompressing the engine. The cam follower is engaged with the small diameter part of the cam in the return stroke to release the decompressing operation, to return to the engine starting position, and to be reset to make the decompression possible. Startability and operability of the engine are improved, and the structure is simple and reliable.

BACKGROUND OF THE INVENTION

In a conventional engine with a kick-type starting device, such as in a motorcycle, particularly when the engine has a single cylinder of large displacement, the resistance in the compression stroke at the time of starting the engine is so high that a large treading force and great skill are required. Thus, the kicking operation is difficult. In the operation of starting the engine by treading the kick-pedal, if the decompression valve or exhaust valve is opened within a range of a fixed area of this operation to decompress the cylinder, the operability of starting the engine will become easy.

A decompressing device at the time of starting the engine wherein a manual operation is used has already been suggested. However, the synchronization of the kick-starting operation and decompressing manual operation is very difficult.

Therefore, various means of carrying out the decompressing operation is operatively connected with the kicking operation have been suggested. In most such kick-starter devices operatively connected with a decompressing device, there are required several complicated mechanisms, such as a plurality of cams and links, and the reliability of the decompressing operation is poor.

Particularly, the operation of decompressing the engine may be made only in a fixed period in the kick-arm treading stroke. Decompression after the engine starts will cause the engine to stop or will cause troubles, such as the generation of noise. Thus, the engine should not be decompressed except in a required minimum period. In the conventional device, in attempting to solve the decompression problems, the structure is complicated, the reliability of the operation is poor, and the decompression continues for an unnecessary period.

Japanese Utility Model Laid-open No. 3324/1972 (Application No. 36158/1971) suggests a structure to solve the problems of the conventional devices. Therein, a cam is rotated by a kick-starter spindle, and the cam is provided adjacent to a fixed member. A terminal metal fixture of a cable operating a decompression valve is inserted between the cam and fixed member. By treading the kick-starter, the cam is rotated by the spindle. By the rotation of the cam, the metal fixture is slid continuously while being held between the cam and fixed member, and thereby the cable is pulled and the decompression valve is operated. In such device, because the cable terminal metal fixture is slid between the cam and fixed wall, the reliability of the operation is poor. Further, the metal fixture will bite in, and will likely cause a faulty operation due to wear by the repetition of the sliding between the cam and fixed wall. Because the metal fixture is held and slid at two points of the cam and fixed wall, it will incur much wear. When such a worn situation occurs, repair will be a problem.

SUMMARY OF THE INVENTION

The present invention provides a decompression operatively connected kick-starter device which includes kick-starter means including a kick-starter spindle, a starter arm, and a starter pedal. The invention also includes a decompression mechanism and a cam operatively and mechanically connected to the kick-starter spindle. The cam has at least two cam parts, one of which is a large diameter part for a decompression operation, and the other of which is a small diameter part for resetting operation, and the cam is rotated by the driving force of the kick-starter spindle. Also provided is a cam follower which is guided by the large diameter part of the cam rotated by a kicking operation at the time of starting and operating the decompression mechanism and whereby a decompression operation is made in response to engagement of the cam follower with the large diameter part of the cam only within the range of a fixed angle of rotation of the kick-starter spindle.

An object of the invention is to provide a decompression operatively connected type kick-starter device wherein a cam is slidably fitted to a starting operating shaft, such as a kick-starter spindle, and is provided with a large diameter part for decompression and a small diameter part for resetting, joining with each other in a single part. A cam follower operating a decompression mechanism is engaged with the cam, is engaged with the large diameter part of the cam in the going stroke of the starting operation to make a decompressing operation, and is engaged with the small diameter part of the cam in the returning stroke to release the decompressing operation, to return to the engine starting position, and to be reset to make the decompression possible.

Another object is to provide a decompression operatively connected type kick-starter device which can be easily operated by a small treading force even in a motorcycle or the like equipped with an engine of a large capacity. The device effects a decompressing operation in a predetermined range at the time of the starting operation of the kick-starter, and greatly improves the starting operability.

Another object is to provide a device wherein a decompressing operation is made only in a fixed range of the kick-starting operation, and is not made in any other range. The required decompression is positively made, and is automatically made as operatively connected with the kick-starter. Thus, even an unskilled person can easily start the engine.

A further object is to provide a decompression operatively connected type kick-starter device which comprises a cam provided with two-step cam parts and formed to be driven by the kick-starter spindle. The cam is slidable in the axial direction and is resiliently pressed in a fixed position. A resiliently pressed cam follower is selectively engaged with the two-step cam parts in a fixed range of the angle of rotation of the spindle.

An object is to obtain a device wherein the device including the decompression releasing mechanism is made as compact as possible. The device has great utility in a motorcycle restricted in space requirements, and is improved in durability.

A further object is to provide a decompression operatively connected type kick-starter device wherein the two-step cam parts of the cam driven by the kick-starter spindle and the cam follower are slid and engaged with each other by the resiliently pressing action of a spring with the variation of the angle of rotation of the spindle. Therefore, the operation is positive and reliable.

DETAILED DESCRIPTION

Figure 1:
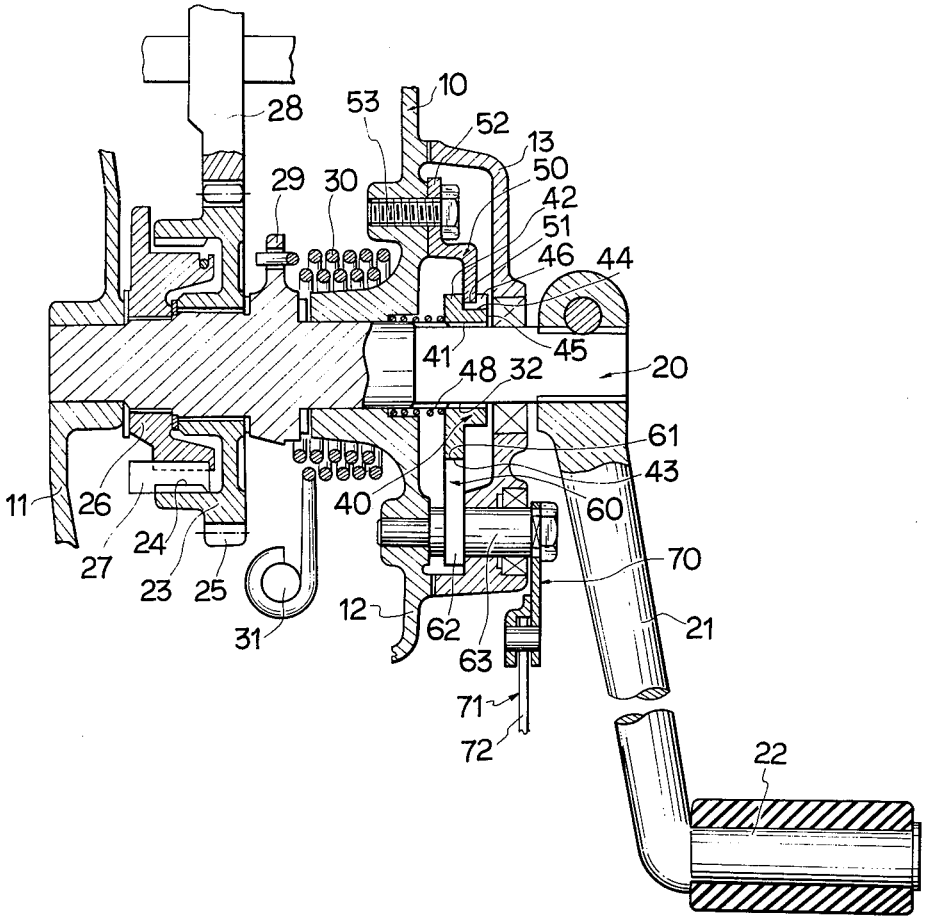
FIG. 1 is a sectional view of an essential part of a kick-starter according to a first embodiment of the invention.

FIG. 1 shows a transmission case 10. A kick-starter spindle 20 is rotatably mounted between an inside partition wall 11 and outer wall 12 of case 10, and has its tip projecting out of wall 12. The base end part of a substantially L-shaped starter arm 21 is secured to this projecting end. A pedal 22 is provided on the horizontal end of arm 21. A starter pinion 23 is rotatably fitted near the rear end part supported by the partition wall of spindle 20. Teeth provided on the inner periphery of pinion 23 are connected with a driving gear 26 provided in the rear part of spindle 20 through a pawl 27 functioning as a one-way clutch so that only at the time of the one-way rotation of spindle 20, i.e., the going stroke in the starting operation, the pinion 23 may be driven. At this time a crankshaft (not shown) may be driven through an idler gear 28 meshing with teeth 25 of pinion 23, power transmission gears, and other parts. An arm 29 is provided to project from the intermediate part of spindle 20. Arm 29 is connected to one end of a return spring 30 connected at its other end to a pin 31 provided on the body side, i.e., the case 10 or the like. By this spring 30, the spindle 20 and arm 21 are returned after spindle 20 is trod down.

Figure 2:
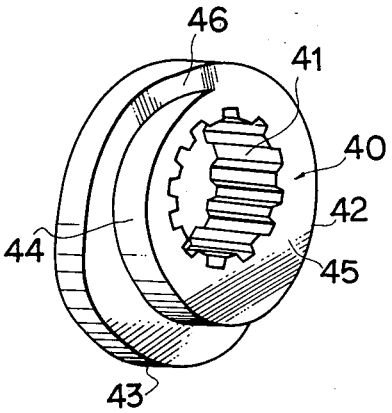
FIG. 2 is a perspective view of a cam.

A cam 40 is provided on the periphery of the base part of the part projected out of wall 12 of the spindle 20. Cam 40 is provided with a spline 41 (FIG. 2), and is fitted to a spline 32 provided on this part of the outer periphery of spindle 20. Therefore, cam 40 is axially slidable in this part with respect to spindle 20, and rotates integrally with spindle 20.

The details of cam 40 are shown in FIGS. 2 to 5.

Figure 5:
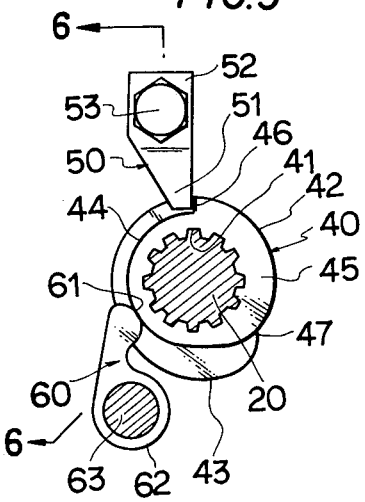
FIG. 5 is a view similar to FIG. 3 but showing the position when the decompressing operation ends.

Cam 40 is provided axially with a large diameter part 43 for decompression. Part 43 is larger in diameter than a base circle part 42 and a small diameter part 44 for resetting. Part 44 is smaller in diameter than part 42. Cam 40 is formed as an integral member. Forward in the starting operation rotating direction of part 44, an inclined part is provided in the axial direction to form a slope 46 for forcibly releasing the decompression. Slope 46 joins the end surface 45 on the small diameter part side of cam 40. At the base end in the starting operation rotating direction of part 44, i.e., in the starting position, there is provided a starting part 47 for joining parts 42 and part 43 in this position, and resetting a cam follower 60 in the starting position. This is best seen in FIGS. 3 to 5.

A spring 48 (FIGS. 1 and 6) is compressed and fitted between the back surface of cam 40 and the spindle 20 supporting part of wall 12 of case 10. Cam 40 is always resiliently pressed toward the outside shaft end of spindle 20 by spring 48.

Figure 3:
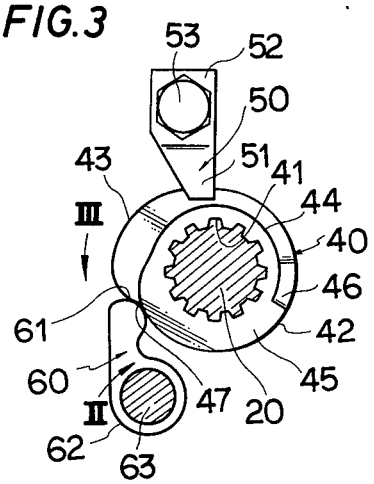
FIG. 3 is a view showing the relation of the cam and cam follower in the starting position.
Figure 4:
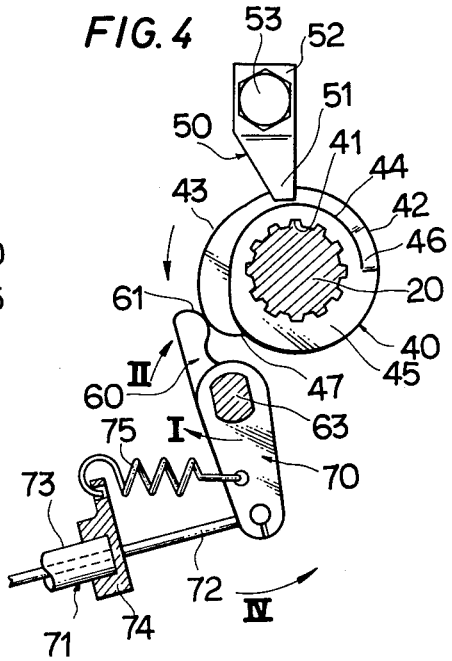
FIG. 4 is a view similar to FIG. 3 but showing the decompressing operation position.

In the starting position of cam 40 shown in FIG. 3, the part 44 engages with tip 51 of a cam guide 50 provided at the outer peripheral part of cam 40. The position of cam 40 on spindle 20 is regulated by the axial resilient press of spring 48. As shown in FIG. 1, cam 40 is set and held in the outermost position on spindle 20 by the engagement of guide 50 with part 44. Guide 50 is substantially Z-shaped on its side, and its base 52 is bolted by bolt 53 in a fixed position on wall 12. The suspended tip 51 of guide 50 engages with part 44 of cam 40, and functions as a stopper regulating the axial slide of cam 40 by spring 48 together with the guiding function.

In a proper position on the outer periphery of cam 40, a cam follower 60 is provided together with guide 50. Follower 60 is secured in its base 62 to a supporting shaft 63 rotatably mounted and supported between wall 12 and cover 13, and is held in a fixed position. Cover 13 covers cam follower 60, cam 40, and cam guide 50, and rotatably supports the tip of spindle 20.

The tip 61 of cam follower 60 is resiliently contacted by the resiliently pressing force of a spring 75 (FIG. 4) with starting part 47 in which the large diameter part 43 and small diameter part 44 join each other in the starting position. As shown in FIG. 1, the tip 61 is in resilient contact with the periphery of part 43.

Shaft 63 projects at one end out of the cover 13. An operating plate 70 (FIGS. 1 and 4) is secured at one end to the projecting end of shaft 63, and is connected at its outer end to one end of an inner cable 72 of a control cable 71 operating a decompressing operation mechanism of the exhaust valve and decompression valve. An outer cable 73 (FIG. 4) is supported by a supporting member 74. Spring 75 is provided between member 74 and plate 70. By spring 75, the plate 70 is resiliently pressed rotatably clockwise as indicated by the arrow I in FIG. 4. Therefore, cam follower 60 secured to shaft 63 is resiliently pressed rotatably in the same direction as indicated by the arrow II with shaft 63 as a fulcrum. Tip 61 is in resilient engagement with cam 40.

The operation by the foregoing mechanism is explained in the following.

FIGS. 1 and 3 show the kick-starter arm 21 in the starting position not operated. Tip 61 of cam follower 60 is resiliently contacted and engaged by the action of spring 75 with starting part 47 of cam 40, as shown in FIG. 3.

Figure 7:
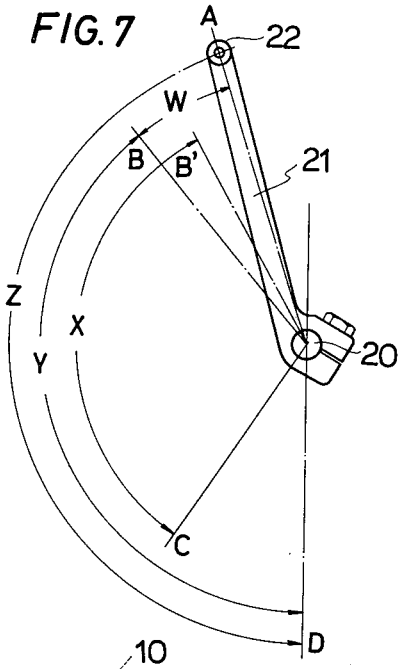
FIG. 7 is an explanatory view of the operation of the kick-starter arm.

FIG. 7 is a view explaining the relation of the operation of the kick-starter arm 21 and the decompressing operation, and shows arm 21 in the starting position before the operation. The operation is explained by using this view, and the side views of the essential parts in FIGS. 3 to 5.

Arm 21 is trod down counter-clockwise in the drawing, by treading the pedal 22 from the position in FIG. 7 to rotate spindle 20 in the same direction.

By the small rotation of arm 21 from point A of the starting position to point B, the spindle 20 will rotate through this angle. Driving gear 26 and starter pinion 23 will mesh and connect with each other through the play of pawl 27 and, after point B, the crankshaft will be driven through idler gear 28. Therefore, the area W from point A to point B is an area of the play of the driving gear and the starter pinion.

By the rotation of spindle 20, the cam 40 will also rotate counter-clockwise as indicated by the arrow III in FIG. 3. By the rotation of cam 40, the cam follower 60 will rock outwardly with shaft 63 as a fulcrum against spring 75 with the cam guiding action of part 43. Follower 60 will pivotally move counter-clockwise integrally with shaft 63. As a result, the operating plate 70 fixed to shaft 63 will rock counter-clockwise by the amount matching the lift by part 43. The inner cable 72 of control cable 71 will be pulled by this amount, and the decompression valve and other parts connected to it will be operated to make a decompressing action. The relation of the cam follower 60 and cam 40 in this position is shown in FIG. 4.

By rotation of spindle 20, the cam 40 provided on it will be integrally rotated. Also, the decompression valve will be opened by the action of cam 40 from point B′ before the point B at which the driving gear 26 and starter pinion 23 engage with each other and make a decompressing action in the angle of rotation after point B′.

Figure 6:
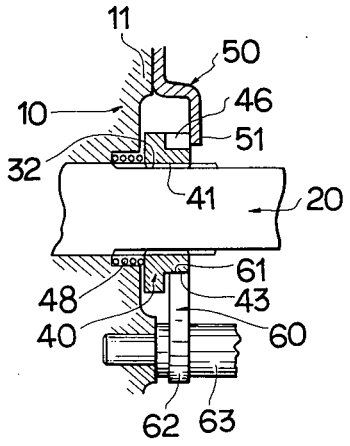
FIG. 6 is an explanatory sectioned view taken along line 6—6 of FIG. 5.

With the continuation of treading down arm 21, the cam 40 will continue to rotate and, by the action of part 43 the cam follower 60 will be rocked. Plate 70 will also be rocked and the decompression valve will be opened. As rotation of cam 40 progresses and the end point of the decompressing operation is reached, guide 50 engaged with part 44 will reach slope 46 and, by the guiding action of slope 46, the cam 40 will be slid on spindle 20 against spring 48 to the inner side in the axial direction with respect to guide 50 on the fixed side. With the guiding action of the slope 46, the tip 51 will reach end surface 45. Thereby, part 43 will be slid rearwardly in the axial direction. Follower 60 which is positioned and fixed in the axial direction will be moved from part 43 to part 44, and will drop onto part 44 by the action of spring 74. This is shown in FIGS. 5 and 6.

As a result, the inner cable 72 will retreat in the direction reverse to the arrow IV in FIG. 4 by the amount of the drop of follower 60, and will be pulled up to close the decompression valve.

The end position of this decompressing operation is point C shown in FIG. 7. The decompressing operation is made in the range of the angle of rotation of the kick-starter from points B′ and C, i.e., in the range shown by area X. The range shown by area Y from points B to C is the effective operating range of arm 21.

When at point D of the final position of treading the arm 21, the kick-starting operation is finished and the pedal 22 treading force is released, by the action of return spring 30, the spindle 20 will be rotated reversely and the arm 21 will return to starting position A shown in FIG. 7. The area Z shown from the points A to D represents the entire operating angle of arm 21.

In this returning motion, cam 40 will also rotate in the reverse direction (clockwise in FIGS. 3 to 5) together with spindle 21. Because follower 60 is engaged with part 44, even though cam 40 is always resiliently pressed in the axial direction by spring 48, the cam 40 will be prevented by follower 60 from sliding in the axial direction. Even if, by the reverse rotation of cam 40, the tip 51 is separated from the end surface and fits part 44, it will not engage with part 44. Follower 60 will engage with part 44 and will keep the decompressing operation stopped.

Cam 40 will continue to rotate reversely, will reach part 47, and will be released from the regulation in the axial direction. Thereby, cam 40 will be slid in the axial direction by the action of spring 48. Follower 60 will engage with the periphery of part 43. Tip 51 will engage with part 44, and will return to the position shown in FIG. 3.

Thus, at the time of the returning rotation of arm 21, by the action of cam 40 and follower 60, no decompressing operation will be made. The decompressing operation will be made only in the fixed period required at the time of the engine starting operation, but will not be made in other period.

Figure 8:
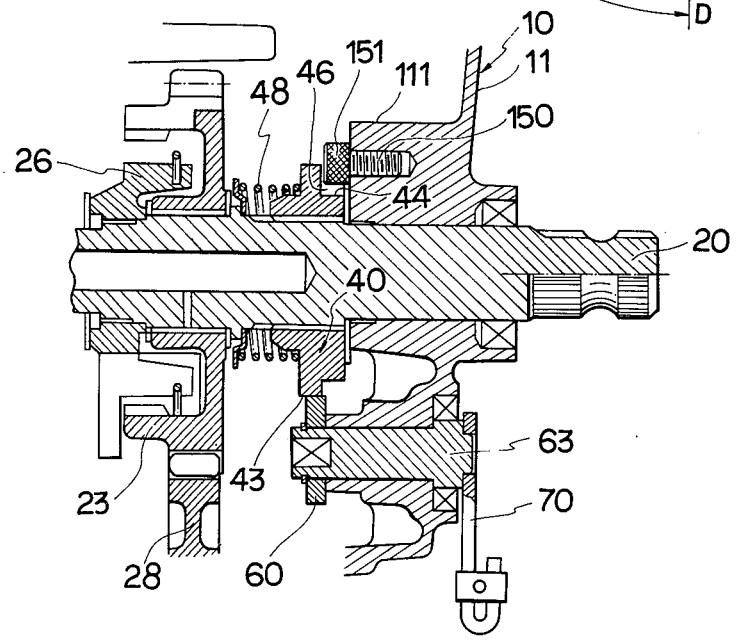
FIG. 8 is a view similar to FIG. 1 but showing a modified embodiment.

FIG. 8 shows a modified embodiment which is fundamentally the same as the first embodiment but the partition plate 11 and cover 13 are eliminated. The mechanism is housed inside the outer wall plate 12 of the transmission case.

In this embodiment, cam guide 150 is a bolt and is fitted to the inside of the bearing boss part 111 of the outer wall 12 of the spindle 20 so that the head 151 of the bolt may be directed inwardly. Head 151 engages with part 44, is engaged with slope 46 by the rotation of the spindle 20 by the starter 21, and retreats cam 40 rearwardly in the axial direction against spring 48 with head 151 on the fixed side.

According to this embodiment, the cam guide is merely a bolt, and the structure is simpler than formation of fixing another member with a bolt as in the first embodiment, and there are fewer parts.

Figure 9:
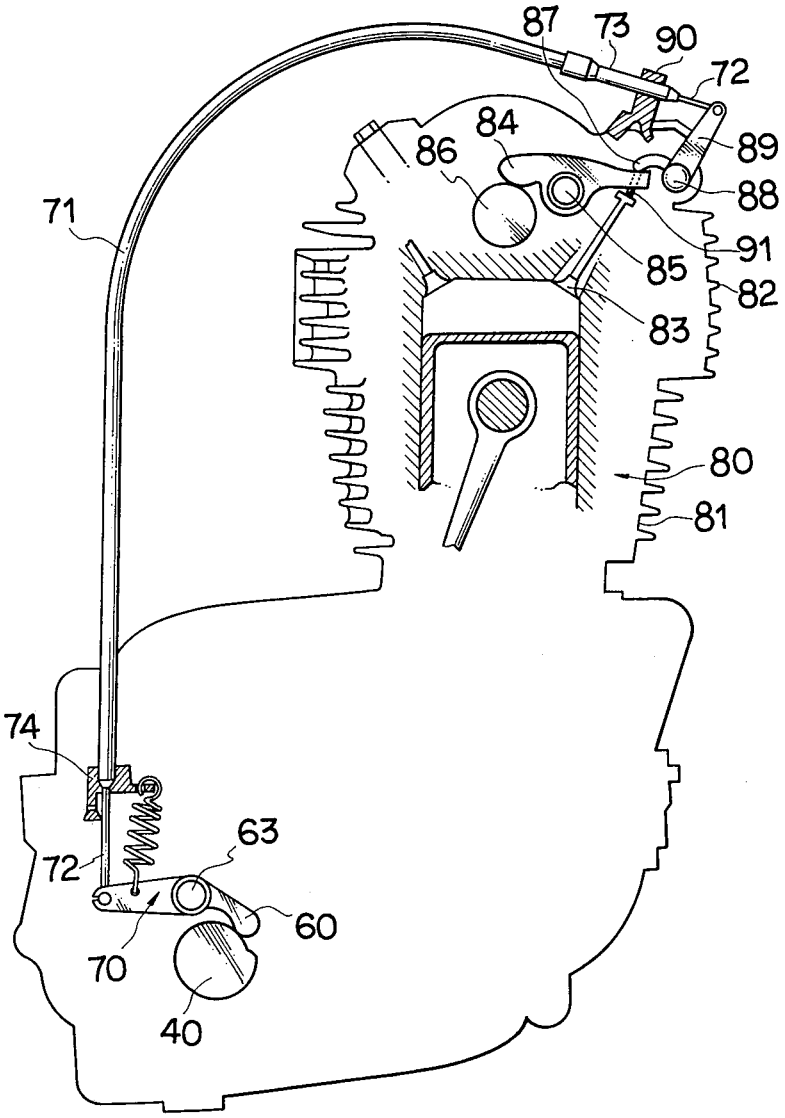
FIG. 9 is an explanatory view of an entire decompression system using the decompression device according to the present invention.

FIG. 9 shows an engine to which the device according to the invention is applied. FIG. 9 schematically shows only the essential parts of the engine.

Cam 40, follower 60, shaft 63 and plate 70 are provided in the rear part of the transmission case of the engine 80, and the operating plate 70 is connected to the inner cable 72 of the cable 71.

In FIG. 9 the exhaust valve is utilized as a decompression valve, and 81 represents a cylinder. A rocker arm 84 is pivotally provided by a pin 85 at the upper end of a rod of an exhaust valve 83 provided to vertically pass through a cylinder head 82 and is driven by a cam shaft 86. A substantially L-shaped operating lever 87 is pivotally provided on the rear end part contacting the upper end of the valve rod part of rocker arm 84, and is contacted at the tip with the upper surface of the rear end part of arm 84. This contacting position is made the closing position of valve 83. Lever 87 is pivotally movable with shaft 88 as a fulcrum. The upward extension 89 of lever 87 is connected to the other end of the inner cable 72 of cable 71. The outer tube 73 of the inner cable 72 is supported by a supporting part 90 provided as raised on the cylinder head 82.

By the kick-starter operation, cam 40 will be rotated and follower 60 and plate 70 will be rocked to pull inner cable 72. Lever 87 connected with cable 72 sill rock counter-clockwise in the drawing with shaft 88 as a fulcrum, and will push down arm 84 in the rear end part from the illustrated position independently of cam shaft 86. Thereby, exhaust valve 83 will be pushed down through the rod part and will open cylinder 81 to attain decompression.

The exhaust valve is utilized as a decompression valve. Alternatively, a valve used exclusively for decompression may be separately provided. By the inventive device, the decompression can be positively made.

In the foregoing embodiments the cam 40 is fitted directly to the kick-starter spindle 20. Alternatively, cam 40 may be provided on another shaft driven by spindle 20. Such a structure will be able to be made in case it is difficult to fit the cam directly to the spindle on the layout within the transmission case.

I claim:

1. A decompression operatively connected kick-starter device comprising:

kick-starter means including a kick-starter spindle, a starter arm, and a starter pedal;

a decompression mechanism;

a cam operatively and mechanically connected to said kick-starter spindle;

said cam having at least two cam parts, one of which is a large diameter part for a decompression operation, and the other of which is a small diameter part for resetting operation;

said cam being rotated by the driving force of said kick-starter spindle;

a cam follower guided by said large diameter part of said cam rotated by a kicking operation at the time of starting and operating said decompression mechanism;

whereby a decompression operation is made in response to engagement of said cam follower with said large diameter part of said cam only within the range of a fixed angle of rotation of said kick-starter spindle;

said cam being provided integrally with said two-step cam parts of said large diameter part for said decompression operation and said small diameter part for said resetting operation;

said cam being slidable in an axial direction with respect to said kick-starter spindle, and being resiliently pressed in one direction in said axial direction;

said decompression mechanism including an exhaust valve or a decompression valve; and said cam follower being engaged and always resiliently pressed in contact with said cam, whereby said decompression operation is made by the engagement of said cam follower with said large diameter part of said cam only in the range of a fixed angle of rotation of the kick-starting operation.

2. A device according to claim 1, wherein:

said cam is provided on said kick-starter spindle slidably in said axial direction and rotatably integrally with said spindle.

3. A device according to claim 2, wherein:

said cam is provided in the end part of said small diameter part with a sloped part joining the end surface in said axial direction of said cam and said small diameter part with a sloped part joining the end surface in said axial direction of said cam and said small diameter part with each other, whereby, with the progress of the rotation of said cam, a cam guide on the fixed side engaged with said sloped part, slides said cam on the shaft against a spring, and disengages said cam follower from said large diameter part.

4. A device according to claim 3, wherein:

said cam guide is formed of a bracket-shaped member provided on the wall supporting said kick-starter spindle.

5. A device according to claim 3, wherein:

said cam guide is formed of a head of a bolt or a pin-shaped member provided on the wall supporting said kick-starter spindle.

6. A device according to claim 2, wherein:

said cam follower engages with said large diameter part of said cam;

a cam guide engages with said small diameter part of said cam and is in the starting position;

said cam follower is rocked by the rotation of said cam with the rotation of said spindle;

said decompression mechanism is connected with said cam follower and is made to make said decompression operation with the progress of the rotation of said cam;

said cam guide is engaged with the sloped part joining said small diameter part and end surface of said cam with each other; and said cam is slid in said axial direction by said cam guide to disengage said cam follower from said large diameter part and to stop said decompression operation and, by the reverse rotation of said cam with the reverse rotation of said spindle, said cam follower and cam guide are disengaged from said small diameter part and end surface of said cam and are returned to engage said large diameter part of said cam.

7. A device according to claim 2, wherein:

said cam follower engages rockably and resiliently in contact with said cam; and an operating plate is operatively connected with said cam, and is made to be connected with said decompression mechanism through a control cable.

8. A device according to claim 1, wherein:

said cam follower engages rockably and resiliently in contact with said cam; and an operating plate is operatively connected with said cam, and is made to be connected with said decompression mechanism through a control cable.

9. A device according to claim 1, wherein:

said cam follower engages rockably and resiliently in contact with said cam; and an operating plate is operatively connected with said cam, and is made to be connected with said decompression mechanism through a control cable.

* * * * *